US009664202B2

(12) United States Patent
McKeeman

(10) Patent No.: US 9,664,202 B2
(45) Date of Patent: May 30, 2017

(54) SYSTEM FOR COOLING A HYPERBARIC CHAMBER

(71) Applicant: Bruce Elgin McKeeman, Mound, MN (US)

(72) Inventor: Bruce Elgin McKeeman, Mound, MN (US)

( * ) Notice: Subject to any disclaimer, the term of this patent is extended or adjusted under 35 U.S.C. 154(b) by 782 days.

(21) Appl. No.: 13/923,467

(22) Filed: Jun. 21, 2013

(65) Prior Publication Data

US 2013/0343875 A1 Dec. 26, 2013

Related U.S. Application Data

(60) Provisional application No. 61/663,093, filed on Jun. 22, 2012.

(51) Int. Cl.

| | |
|---|---|
| ***F04D 29/58*** | (2006.01) |
| ***A61G 10/02*** | (2006.01) |
| *F24F 5/00* | (2006.01) |

(52) U.S. Cl.

CPC ..... *F04D 29/58* (2013.01); *A61G 10/026* (2013.01); *F24F 5/0085* (2013.01); *A61G 2210/70* (2013.01); *F24F 5/00* (2013.01)

(58) Field of Classification Search

CPC ..... F24F 11/0001; F24F 2011/0004; F24F 2011/0042; F24F 2011/0005; F24F 11/04; F24F 5/00; F24F 5/0085; A61G 10/00; A61G 10/02; A61G 10/023; A61G 10/026; A61G 2210/70; F04D 29/58; F25B 9/004

USPC ..... 454/238, 187, 239, 370; 415/116; 251/304; 128/205.24, 205.26, 202.12

See application file for complete search history.

(56) References Cited

U.S. PATENT DOCUMENTS

| | | | | | |
|---|---|---|---|---|---|
| 4,230,107 | A * | 10/1980 | Butler | B63C 11/325 | 128/205.26 |
| 5,327,904 | A * | 7/1994 | Hannum | A62B 31/00 | 128/202.12 |
| 5,618,126 | A * | 4/1997 | Watt | A61G 10/026 | 294/68.1 |
| 5,678,543 | A * | 10/1997 | Bower | A62B 31/00 | 128/202.12 |
| 5,685,293 | A * | 11/1997 | Watt | A61G 10/026 | 128/202.12 |
| 2002/0121331 | A1* | 9/2002 | Gerresheim | B29C 73/163 | 156/115 |
| 2007/0276268 | A1* | 11/2007 | Edgerley | A61B 5/0235 | 600/498 |
| 2008/0006272 | A1* | 1/2008 | Lewis | A61G 10/026 | 128/205.26 |

(Continued)

*Primary Examiner* — Gregory Huson
*Assistant Examiner* — Dana Tighe

(57) ABSTRACT

A system for cooling a hyperbaric chamber includes a compressor, a first hose, a cooling unit, a second hose, and a hyperbaric chamber. The first hose fluidly connects the compressor to the cooling unit, and the second hose fluidly connects the cooling units to the hyperbaric chamber. Compressed air from the compressor travels through a first pressure relief fitting and a second pressure relief fitting, where the compressed air is depressurized according to the system requirements. During the depressurization, the compressed air cools down because of the depressurization and creates a comfortable environment within the hyperbaric chamber.

7 Claims, 10 Drawing Sheets

(56) References Cited

U.S. PATENT DOCUMENTS

| | | | | |
|---|---|---|---|---|
| 2009/0120433 | A1* | 5/2009 | Loori | A61G 10/026<br>128/202.12 |
| 2011/0198524 | A1* | 8/2011 | Wood | F16K 11/074<br>251/304 |

* cited by examiner

SYSTEM FOR COOLING A HYPERBARIC CHAMBER

The current application claims a priority to the U.S. Provisional Patent application Ser. No. 61/663,093 filed on Jun. 22, 2012.

FIELD OF THE INVENTION

The present invention relates generally to a system for cooling a hyperbaric chamber. More specifically, the present invention routes a compressor through a cooling system, reducing pressure and temperature in a connected hyperbaric chamber.

BACKGROUND OF THE INVENTION

Hyperbaric chambers are commonly used in the fields of diving and hyperbaric medicine. Hyperbaric chambers are pressurized vessels designed for human occupancy, and can be designed with either a soft or hard shelled construction. The act of pressurizing air generates heat in the enclosed environment of the hyperbaric chamber. As a result, hyperbaric chambers without a cooling system result in a very hot and uncomfortable environment.

Because of the heat generated in a hyperbaric chamber, many existing hyperbaric chambers include some sort of cooling system. Cooling systems utilize various methods and equipments, including chillers and chlorofluorocarbon based coolers, such as Freon. These cooling systems are used to moderate the temperature in hyperbaric chambers, cooling the air to comfortable levels for occupants. However, these methods have drawbacks. Chillers have issues with condensation and mold, and also tend to be high maintenance. Chlorofluorocarbon based coolers have no sound reducing qualities and have potentially harmful effects on certain individuals and the environment. In general, existing cooling solutions are some combination of loud, unsanitary, hazardous, and difficult to maintain.

It is therefore an object of the present invention to provide a system for cooling a mild hyperbaric chamber with a passive design. The present invention accomplishes this by arranging a series of pressure relief valves between a compressor, a cooling unit, and hyperbaric chamber, where the present invention cools the compressed air by reducing pressure of the compressed air on its path to the hyperbaric chamber from the compressor.

DETAIL DESCRIPTIONS OF THE INVENTION

All illustrations of the drawings are for the purpose of describing selected versions of the present invention and are not intended to limit the scope of the present invention.

Figure 1:
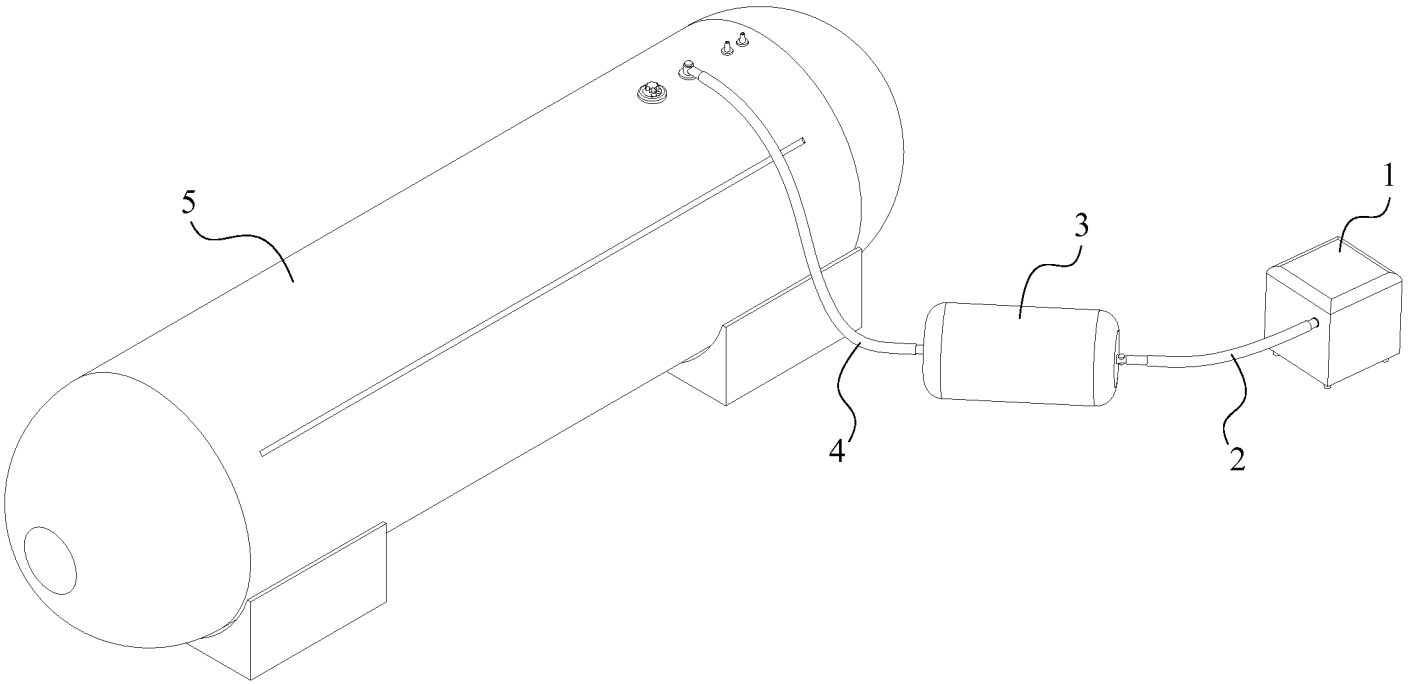
FIG. 1 is a perspective view of the present invention.

The present invention is a system for cooling a hyperbaric chamber which comprises a compressor 1, a first hose 2, a cooling unit 3, a second hose 4, and a hyperbaric chamber 5. In reference to FIG. 1, the compressor 1 is fluidly connected with the cooling unit 3 by the first hose 2, and the cooling unit 3 is fluidly connected with the hyperbaric chamber 5 by the second hose 4.

The compressor 1 used within the present invention can be any type of air compressor 1 which is able to compress or pressurize air so that the cooling unit 3 and the hyperbaric chamber 5 can be pressurized according to system requirements. Since the compression of the air generates heat; compressed air from the compressor 1 outputs warm air compare to the ambient temperature. The compressor 1 comprises a male compressed air outlet, where the male compressed air outlet outputs the warm compressed air for the cooling unit 3 and the hyperbaric chamber 5.

Figure 2:
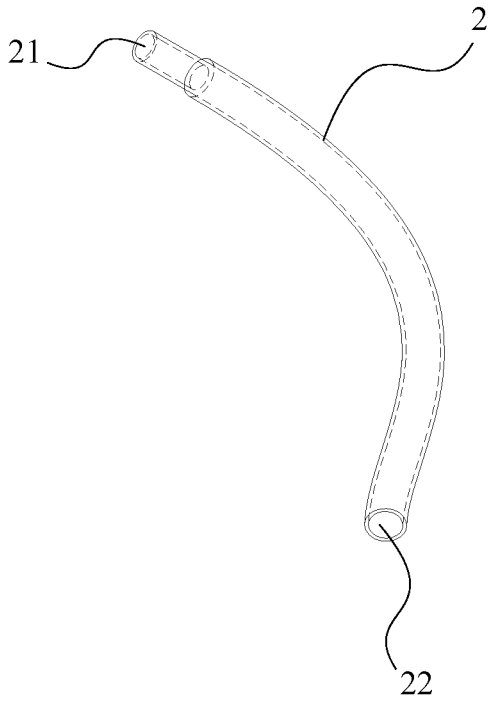
FIG. 2 is a perspective view of a first hose of the present invention, wherein the dash-lines illustrate the inside wall of the first hose.
Figure 3:
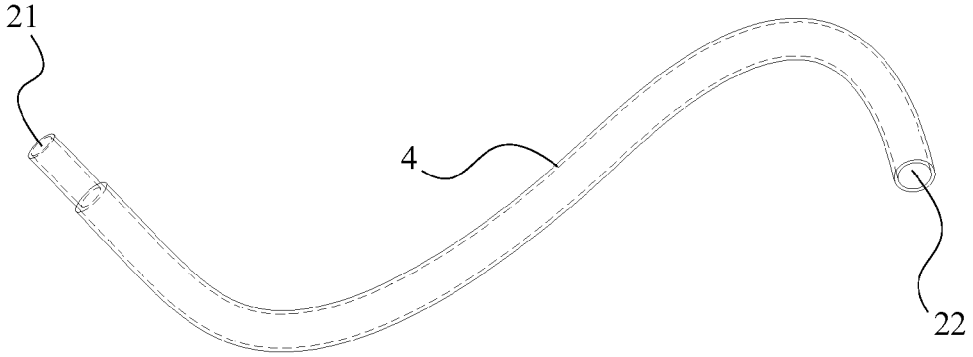
FIG. 3 is a perspective view of a second hose of the present invention, wherein the dash-lines illustrate the inside wall of the second hose.

In reference to FIG. 2 and FIG. 3, the first hose 2 and the second hose 4 each comprises a male attachment opening 21 and a female attachment opening 22. The male attachment opening 21 and the female attachment opening 22 are oppositely positioned from each other along the first hose 2 and the second hose 4. The first hose 2 and the second hose 4 are preferably made from flexible medical grade polyvinyl chloride (PVC) or any other type of flexible biocompatible materials as the first hose 2 connects in between the compressor 1 and the cooling unit 3, and the second hose 4 connects in between the cooling unit 3 and the hyperbaric chamber 5.

Figure 4:
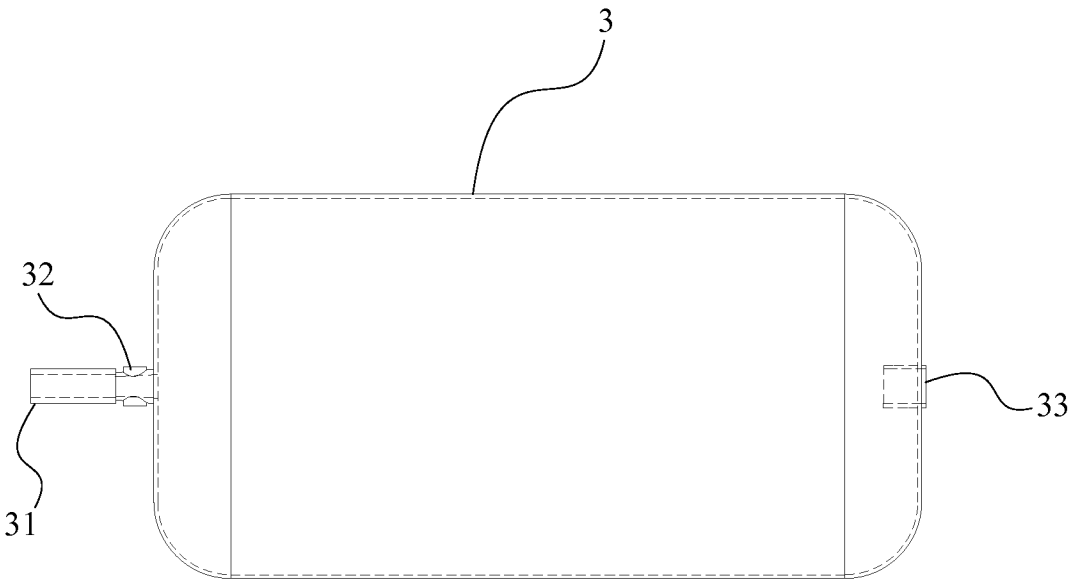
FIG. 4 is a front view of a cooling unit of the present invention, wherein the dash-lines illustrate the inside wall of the cooling unit.

In reference to FIG. 4, the cooling unit 3 comprises a male attachment inlet 31, a first pressure relief fitting 32, and a female attachment outlet 33. The cooling unit 3 is a sealed enclosure with two openings, where the two openings are the male attachment inlet 31 and the female attachment outlet 33. The cooling unit 3 has a flexible shell and preferably made into a cylindrical shape. In a preferred embodiment of the present invention, the cooling unit 3 has a length of 24 inches and a diameter of 10 inches, but the size of the cooling unit 3 can be increased or decreased depending on the hyperbaric chamber 5. The first pressure relief fitting 32 is fluidly connected with the cooling unit 3 from one end, and the male attachment inlet 31 is fluidly connected with the first pressure relief fitting 32. As show in FIG. 7, the male attachment opening 21 of the first hose 2 is fluidly connected with the female compressed air outlet of the compressor 1, and the female attachment opening 22 of the first hose 2 is fluidly connected with the male attachment inlet 31, where the first hose 2 is able to transport the warm compressed air from the compressor 1 to the male attachment inlet 31. Then the warm compressed air travels from the male attachment inlet 31 to the first pressure relief fitting 32 which depressurizes the warm compressed air. For example, if the compressor 1 generates 15 pounds per square inch (psi) compressed air, the first pressure relief fitting 32 converts the 15 psi compressed air into 8 psi compressed air. When the warm compressed air is depressurized from the first pressure relief fitting 32 and released into the cooling unit 3, the warm compressed air expands within the cooling unit 3. The expansion of the warm compressed air absorbs some of the generated heat, converting the warm compressed air into cool compressed air within the cooling unit 3. As a result, the cool compressed air leaves the cooling unit 3 at a lower temperature and a lower pressure than it has when generated at the compressor 1. The female attachment outlet 33 is fluidly connected with the cooling unit 3 and positioned oppositely from the male attachment inlet 31. The male attachment opening 21 of the second hose 4 is fluidly connected with the female attachment outlet 33 so that the cooling unit 3 can be connected with the hyperbaric chamber 5 through the second hose 4.

The cooling unit 3 of the present invention completely eliminates existing cooling methods such as the chillers and chlorofluorocarbon based coolers and their respective disadvantages. The chillers normally create condensation and mold problems over time while the chlorofluorocarbon based coolers are hazardous for certain individuals and environment. Since the cooling unit 3 does not use any ice or chlorofluorocarbon to reduce the temperature of the compressed air, condensation problems, mold problems, and high maintenance cost don't occur within the cooling unit 3 of the present invention. The passive nature of the cooling unit 3 of the present invention also reduces the complexity compared to existing cooling methods, where the reduced complexity results into corresponding decrease in cost and maintenance. The cooling unit 3 also does not require any additional energy source to operate within the present invention.

Figure 5:
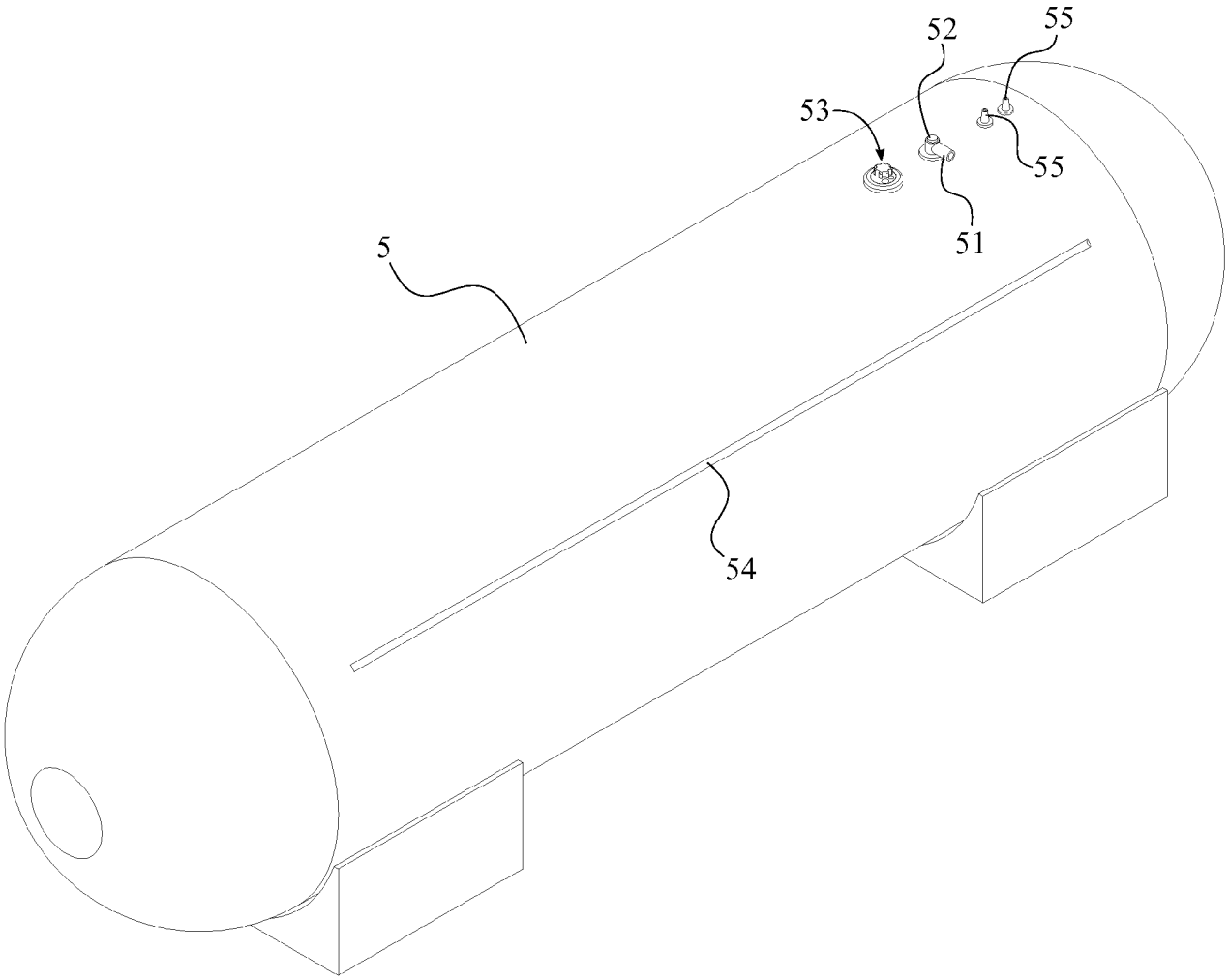
FIG. 5 is a perspective view of a hyperbaric chamber of the present invention.
Figure 7:
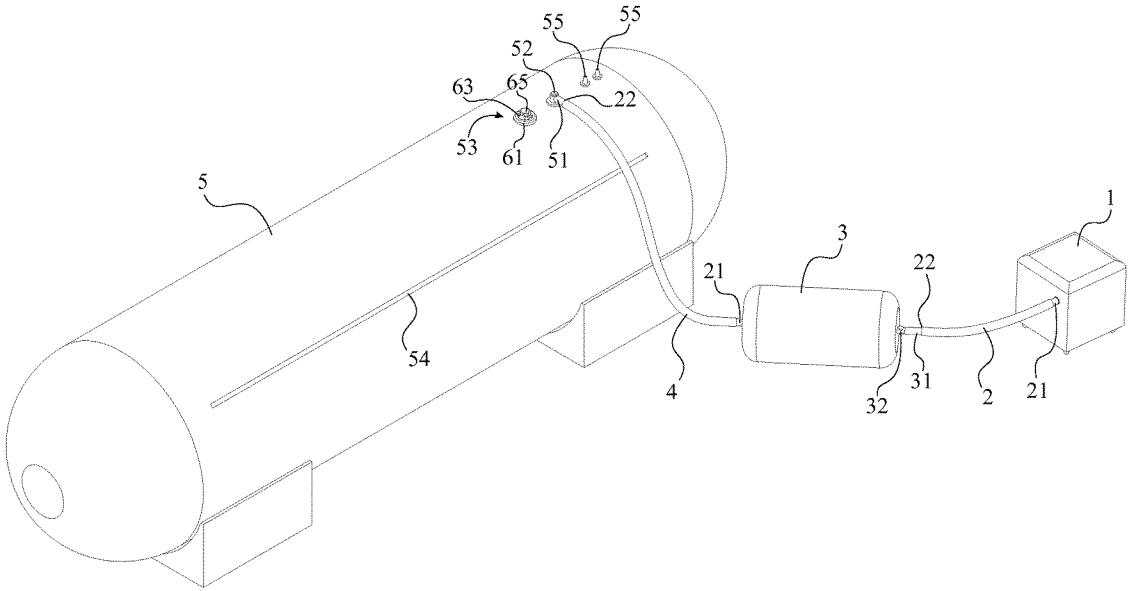
FIG. 7 is another perspective view of the present invention.

In reference to FIG. 5, the hyperbaric chamber 5 comprises an inlet male attachment 51, a second pressure relief fitting 52, a dump valve 53, an access opening 54, and at least one auxiliary valve 55. The hyperbaric chamber 5 is a pressurized vessel which creates a controlled environment so that patients can rest during the medical treatments. The hyperbaric chamber 5 is preferably made into a cylindrical shape, but is not limited only to the cylindrical shape and can be any other geometrical shapes. The access opening 54 is positioned along the hyperbaric chamber 5 and provides an opening so that the patients can move in and out of the hyperbaric chamber 5. The access opening 54 is hermetically sealed by a fastening mechanism during the operation of the present invention so that the pressurized air can be withheld within the hyperbaric chamber 5. For safety purposes, the fastening mechanism can be opened or closed from inside of the hyperbaric chamber 5 or the outside of the hyperbaric chamber 5. The second pressure relief fitting 52 is fluidly connected with the hyperbaric chamber 5, and the inlet male attachment 51 is fluidly connected with the second pressure relief fitting 52. As shown in FIG. 7, the female attachment opening 22 of the second hose 4 is fluidly connected with the inlet male attachment 51, where the second hose 4 is able to transport the cool compressed air from the cooling unit 3 to the inlet male attachment 51. Then the cool compressed air travels from the inlet male attachment 51 to the second pressure relief fitting 52 which further depressurizes the cool compressed air within the present invention. For example, if the cool compressed air is depressurized up to 8 psi within the cooling unit 3, the second pressure relief fitting 52 converts the 8 psi compressed air into 4 psi compressed air. When the cool compressed air is depressurized from the second pressure relief fitting 52 and released into the hyperbaric chamber 5, the cool compressed air expands within the hyperbaric chamber 5. The expansion of the cool compressed air absorbs some of the heat within, converting the cool compressed air into cooler compressed air within the hyperbaric chamber 5. The second pressure relief fitting 52 brings down the pressure of the cool compressed air from the cooling unit 3 into the desired pressure of the hyperbaric chamber 5 so that the hyperbaric chamber 5 can be pressurized into the desired pressure with the comfortable temperature setting. As a result of the pressure reduction in the first pressure relief fitting 32 and the second pressure relief fitting 52 along with the cooling unit 3, the temperature of the compressed air inside the hyperbaric chamber 5 of the present invention is significantly cooler compare to a hyperbaric chamber with a direct compressor connection. The first pressure relief fitting 32 and the second pressure relief fitting 52 can also be replace with depressurizing nozzles within the present invention as long as the depressurizing nozzles can bring down the pressure of the compressed air.

Figure 6:
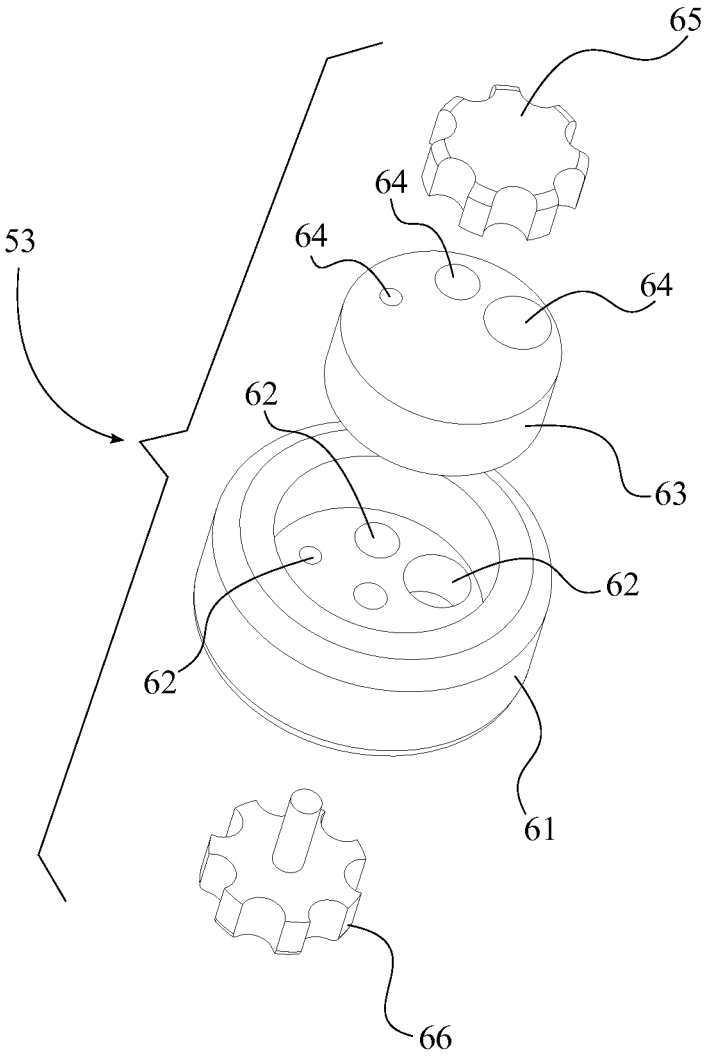
FIG. 6 is an exploded view of a dump valve of the present invention.

The dump valve 53 is fluidly connected with the hyperbaric chamber 5, where the dump valve 53 allows the patients or a responsible individual to control the inside pressure of the hyperbaric chamber 5. In reference to FIG. 6, the dump valve 53 comprises a stationary plate 61, a plurality of stationary holes 62, a rotary plate 63, a plurality of rotary holes 64, an outside knob 65, and an inside knob 66. The stationary plate 61 is connected with the hyperbaric chamber 5, and the plurality of stationary holes 62 is radially positioned on the stationary plate 61. Each of the plurality of stationary holes 62 has a different diameter, where each of the plurality of stationary holes 62 differs from one another. The rotary plate 63 is rotatably connected with the stationary plate 61, where the rotary plate 63 is adjacently positioned with the stationary plate 61 from outside of the hyperbaric chamber 5. The plurality of rotary holes 64 is radially positioned on the rotary plate 63. Each of the plurality of rotary holes 64 has a different diameter, where each of the plurality of rotary holes 64 differs from one another. Since each of the plurality of stationary holes 62 and each of the plurality of rotary holes 64 have different diameter, The plurality of stationary holes 62 and the plurality of rotary holes 64 are positioned in order of increasing size, such that a small hole is adjacent to a medium hole, the medium hole is in between the small hole and a large hole, and the large hole is adjacent to the medium hole. The outside knob 65 is concentrically connected with the rotary plate 63 which allows the individuals standing outside of the hyperbaric chamber 5 to control inside pressure of the hyperbaric chamber 5. The inside knob 66 is concentrically traversed through the stationary plate 61 and connected with the rotary plate 63 in such way that the inside knob 66 is oppositely positioned from the outside knob 65. The inside knob 66 allows a patient within the hyperbaric chamber 5 to control the inside pressure of the hyperbaric chamber 5 without leaving the hyperbaric chamber 5.

Figure 8:
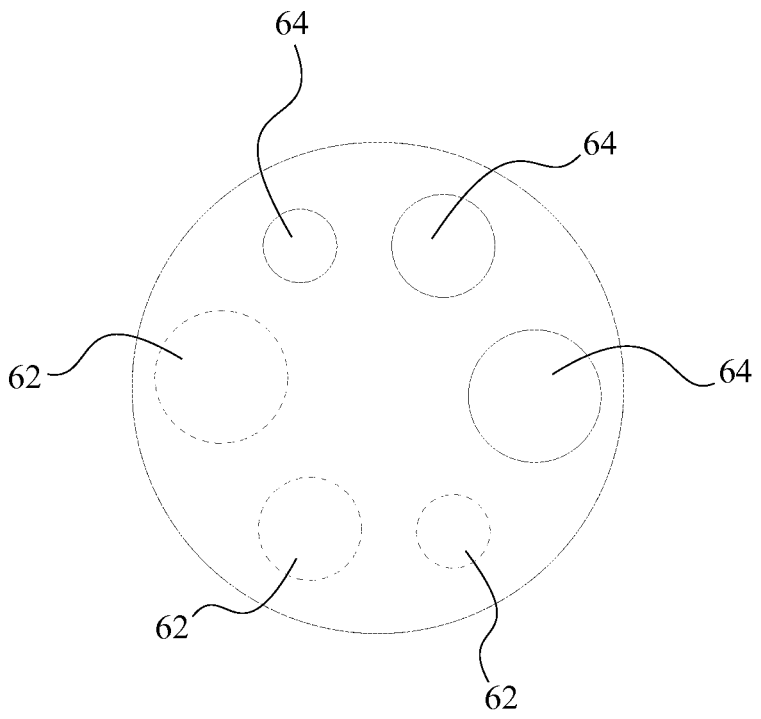
FIG. 8 is a top basic view of the dump valve, wherein a plurality of rotary holes is completely sealed relative to a plurality of stationary holes.
Figure 9:
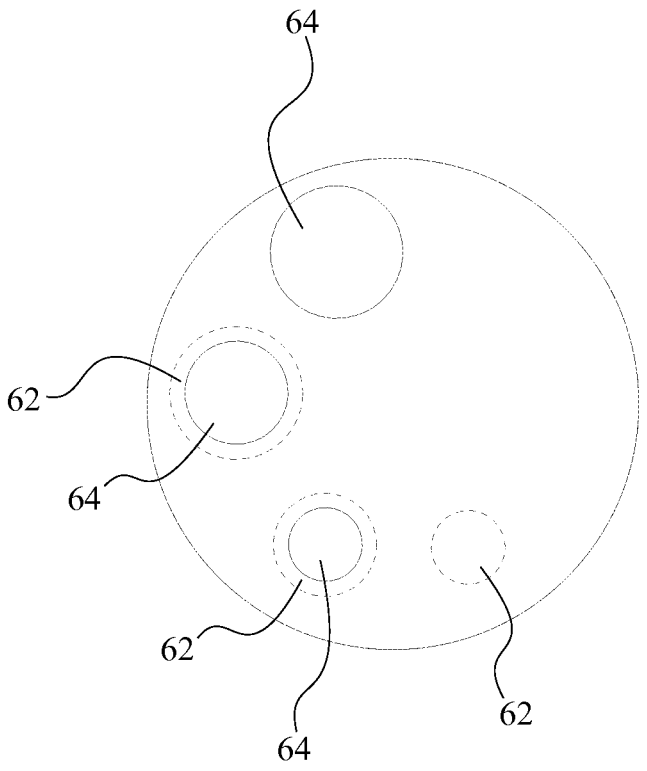
FIG. 9 is a top basic view of the dump valve, wherein the plurality of rotary holes is partially opened relative to the plurality of stationary holes.
Figure 10:
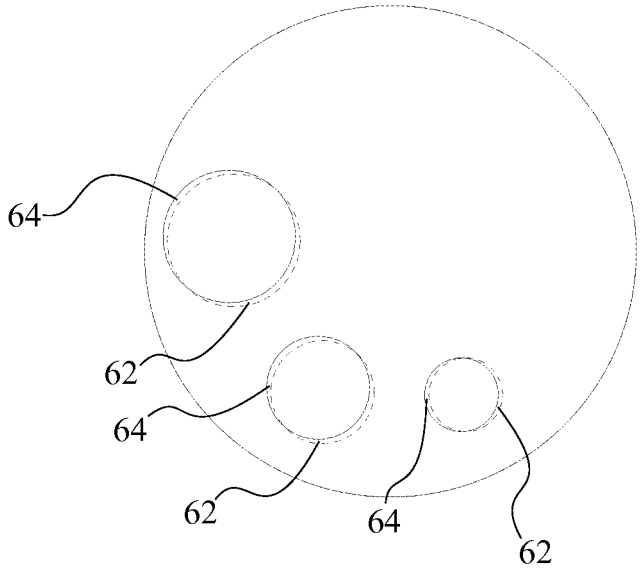
FIG. 10 is a top basic view of the dump valve, wherein the plurality of rotary holes is fully opened relative to the plurality of stationary holes.

The dump valve 53 is operated by turning the outside knob 65 or the inside knob 66 which turns the rotary plate 63, changing the alignment of the plurality of rotary holes 64 with respect to the plurality of stationary holes 62. In reference to FIG. 8, when none of the plurality of rotary holes 64 is aligned with the plurality of stationary holes 62, the dump valve 53 is completely sealed and the pressure inside the hyperbaric chamber 5 remains constant. In reference to FIG. 10, when all of the plurality of rotary holes 64 is aligned with the plurality of stationary holes 62, the dump valve 53 is working at its full capacity. As shown in FIG. 9, by only aligning some of the plurality of rotary holes 64 with the plurality of stationary holes 62, the dump valve 53 can be used to adjust the rate of depressurization. For example, the large hole of the plurality of stationary holes 62 can be aligned with the small hole of the plurality of rotary holes 64, letting out a small amount of air, since the small hole of the plurality of rotary holes 64 bottlenecks the large hole of the plurality of stationary holes 62. Or the large hole and the medium hole of the plurality of stationary holes 62 can be aligned with the medium hole and the small hole of the plurality of rotary holes 64, which would release a larger amount of air. These two sample configurations allow some depressurization to occur, but not as much when compared to having all of the plurality of rotary holes 64 align with the plurality of stationary holes 62. In reference to FIG. 7, the at least one auxiliary valve 55 is fluidly connected with the hyperbaric chamber 5.

The cooling unit 3 acts as a muffler when the compressed air travels through the cooling unit 3 and damps the sound waves from the compressor 1. The cooling unit 3 isolates noises from the compressor 1, specifically the motor, as well as reducing sound from the air. Since the cooling unit 3 is passive, it has a net reduction on noise levels compare to the existing cooling methods. Reduction of the sound level within the present invention creates a comfortable and quiet environment within the hyperbaric chamber 5 for the patient.

Although the invention has been explained in relation to its preferred embodiment, it is to be understood that many other possible modifications and variations can be made without departing from the spirit and scope of the invention as hereinafter claimed.

What is claimed is:

1. A cooling system comprises:

a compressor;

a first hose;

a cooling unit;

a second hose;

a hyperbaric chamber;

the first hose and the second hose each comprises a male attachment opening and a female attachment opening;

the cooling unit comprises a male attachment inlet, a first pressure relief fitting, and a female attachment outlet;

the hyperbaric chamber comprises an inlet male attachment, a second pressure relief fitting, a dump valve, an access opening, and at least one auxiliary valve;

the compressor being fluidly connected with the cooling unit by the first hose;

the cooling unit being fluidly connected with the hyperbaric chamber by the second hose;

the male attachment opening and the female attachment opening being oppositely positioned from each other along the first hose and the second hose;

the first pressure relief fitting being fluidly connected with the cooling unit;

the male attachment inlet being fluidly connected with the first pressure relief fitting;

the female attachment outlet being fluidly connected with the cooling unit;

the female attachment outlet being oppositely positioned from the male attachment inlet;

the male attachment opening of the first hose being fluidly connected with the compressor;

the female attachment opening of the first hose being fluidly connected with the male attachment inlet;

the male attachment opening of the second hose being fluidly connected with the female attachment outlet;

the female attachment opening of the second hose being fluidly connected with the inlet male attachment;

the second pressure relief fitting being fluidly connected with the hyperbaric chamber;

the inlet male attachment being fluidly connected with the second pressure relief fitting;

the dump valve being fluidly connected with the hyperbaric chamber;

the access opening being positioned along the hyperbaric chamber;

the at least one auxiliary valve being fluidly connected with the hyperbaric chamber;

the dump valve comprises a stationary plate, a plurality of stationary holes, a rotary plate, a plurality of rotary holes, an outside knob, and an inside knob;

the stationary plate being connected with the hyperbaric chamber;

the plurality of stationary holes being radially positioned on the stationary plate;

the rotary plate being rotatably connected with the stationary plate;

the rotary plate being adjacently positioned with the stationary plate outside the hyperbaric chamber;

the plurality of rotary holes being radially positioned on the rotary plate;

the outside knob being concentrically connected with the rotary plate;

the outside knob being positioned outside of the hyperbaric chamber;

the inside knob being concentrically traversed through the stationary plate and connected with the rotary plate; and the inside knob being oppositely positioned from the outside knob and within the hyperbaric chamber.

2. A cooling system comprises:

a compressor;

a first hose;

a cooling unit;

a second hose;

a hyperbaric chamber;

the first hose and the second hose each comprises a male attachment opening and a female attachment opening;

the cooling unit comprises a male attachment inlet, a first pressure relief fitting, and a female attachment outlet;

the hyperbaric chamber comprises an inlet male attachment, a second pressure relief fitting, a dump valve, an access opening, and at least one auxiliary valve;

the first pressure relief fitting being fluidly connected with the cooling unit;

the male attachment inlet being fluidly connected with the first pressure relief fitting;

the female attachment outlet being fluidly connected with the cooling unit;

the female attachment outlet being oppositely positioned from the male attachment inlet;

the compressor being fluidly connected with the cooling unit by the first hose;

the cooling unit being fluidly connected with the hyperbaric chamber by the second hose;

the dump valve comprises a stationary plate, a plurality of stationary holes, a rotary plate, a plurality of rotary holes, an outside knob, and an inside knob;

the stationary plate being connected with the hyperbaric chamber;

the plurality of stationary holes being radially positioned on the stationary plate;

the rotary plate being rotatably connected with the stationary plate;

the rotary plate being adjacently positioned with the stationary plate outside the hyperbaric chamber;

the plurality of rotary holes being radially positioned on the rotary plate;

the outside knob being concentrically connected with the rotary plate;

the outside knob being positioned outside of the hyperbaric chamber;

the inside knob being concentrically traversed through the stationary plate and connected with the rotary plate; and the inside knob being oppositely positioned from the outside knob and within the hyperbaric chamber.

3. The cooling system as claimed in claim 2 comprises:

the male attachment opening and the female attachment opening being oppositely positioned from each other along the first hose and the second hose.

4. The cooling system as claimed in claim 2 comprises:

the second pressure relief fitting being fluidly connected with the hyperbaric chamber;

the inlet male attachment being fluidly connected with the second pressure relief fitting;

the dump valve being fluidly connected with the hyperbaric chamber;

the access opening being positioned along the hyperbaric chamber; and the at least one auxiliary valve being fluidly connected with the hyperbaric chamber.

5. The cooling system as claimed in claim 2 comprises:

the male attachment opening of the first hose being fluidly connected with the compressor;

the female attachment opening of the first hose being fluidly connected with the male attachment inlet;

the male attachment opening of the second hose being fluidly connected with the female attachment outlet; and the female attachment opening of the second hose being fluidly connected with the inlet male attachment.

6. A cooling system comprises:

a compressor;

a first hose;

a cooling unit;

a second hose;

a hyperbaric chamber;

the first hose and the second hose each comprises a male attachment opening and a female attachment opening;

the cooling unit comprises a male attachment inlet, a first pressure relief fitting, and a female attachment outlet;

the hyperbaric chamber comprises an inlet male attachment, a second pressure relief fitting, a dump valve, an access opening, and at least one auxiliary valve;

the first pressure relief fitting being fluidly connected with the cooling unit;

the male attachment inlet being fluidly connected with the first pressure relief fitting;

the female attachment outlet being fluidly connected with the cooling unit;

the female attachment outlet being oppositely positioned from the male attachment inlet;

the second pressure relief fitting being fluidly connected with the hyperbaric chamber;

the inlet male attachment being fluidly connected with the second pressure relief fitting;

the dump valve being fluidly connected with the hyperbaric chamber;

the access opening being positioned along the hyperbaric chamber;

the at least one auxiliary valve being fluidly connected with the hyperbaric chamber;

the compressor being fluidly connected with the cooling unit by the first hose;

the cooling unit being fluidly connected with the hyperbaric chamber by the second hose;

the male attachment opening of the first hose being fluidly connected with the compressor;

the female attachment opening of the first hose being fluidly connected with the male attachment inlet;

the male attachment opening of the second hose being fluidly connected with the female attachment outlet;

the female attachment opening of the second hose being fluidly connected with the inlet male attachment;

the dump valve comprises a stationary plate, a plurality of stationary holes, a rotary plate, a plurality of rotary holes, an outside knob, and an inside knob;

the stationary plate being connected with the hyperbaric chamber;

the plurality of stationary holes being radially positioned on the stationary plate;

the rotary plate being rotatably connected with the stationary plate;

the rotary plate being adjacently positioned with the stationary plate outside the hyperbaric chamber;

the plurality of rotary holes being radially positioned on the rotary plate;

the outside knob being concentrically connected with the rotary plate;

the outside knob being positioned outside of the hyperbaric chamber;

the inside knob being concentrically traversed through the stationary plate and connected with the rotary plate; and the inside knob being oppositely positioned from the outside knob and within the hyperbaric chamber.

7. The cooling system as claimed in claim 6 comprises:

the male attachment opening and the female attachment opening being oppositely positioned from each other along the first hose and the second hose.

* * * * *